US007556003B2

(12) United States Patent
Fujii et al.

(10) Patent No.: US 7,556,003 B2
(45) Date of Patent: Jul. 7, 2009

(54) ENGINE VALVE OPERATING SYSTEM

(75) Inventors: Noriaki Fujii, Wako (JP); Katsunori Nakamura, Wako (JP); Akiyuki Yonekawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/585,888

(22) PCT Filed: Jan. 13, 2005

(86) PCT No.: PCT/JP2005/000291

§ 371 (c)(1),
(2), (4) Date: Jul. 23, 2008

(87) PCT Pub. No.: WO2005/068790

PCT Pub. Date: Jul. 28, 2005

(65) Prior Publication Data

US 2008/0276890 A1 Nov. 13, 2008

(30) Foreign Application Priority Data

Jan. 16, 2004 (JP) ..... 2004-009394
Dec. 3, 2004 (JP) ..... 2004-350753

(51) Int. Cl.
*F01L 1/18* (2006.01)

(52) U.S. Cl. ..... 123/90.39; 123/90.16; 123/90.44; 74/569

(58) Field of Classification Search ..... 123/90.39, 123/90.44, 90.6, 90.16; 74/559, 567, 569
See application file for complete search history.

(56) References Cited

U.S. PATENT DOCUMENTS 7,444,966 B2 * 11/2008 Fujii et al. ..... 123/90.16

FOREIGN PATENT DOCUMENTS

EP 1 533 486 A1 5/2005

(Continued)

OTHER PUBLICATIONS

Supplementary European Search Report dated Nov. 7, 2008.

*Primary Examiner*—Ching Chang
(74) *Attorney, Agent, or Firm*—Kratz, Quintos & Hanson, LLP

(57) ABSTRACT

An engine valve operating system is provided in which one end of a first link arm (61) turnably supported at a fixed position of an engine body and the other end of a second link arm (62) turnably supported by a displaceable movable shaft (68*a*) are turnably connected to a rocker arm (63) which has a cam abutting portion (65) abutting against a valve operating cam (69) and is interlocked and connected so as to apply a force in a valve opening direction to an engine valve (19) biased by a valve spring (24) in a valve closing direction. A rocker arm biasing spring (54) which is different from the valve spring (24) biases the rocker arm (63) in a direction in which the cam abutting portion (65) abuts against the valve operating cam (69). This ensures follow-up ability of the opening/closing operations and enables a reduction in the size of the system, while allowing the lift amount of the engine valve to vary continuously. It is also possible to improve the accuracy with which the lift amount is controlled when the engine valve is to be slightly opened.

10 Claims, 12 Drawing Sheets

FOREIGN PATENT DOCUMENTS

| | | | |
|---|---|---|---|
| EP | 1 548 240 | A1 | 6/2005 |
| EP | 1 707 765 | A1 | 10/2006 |
| JP | 62-185809 | | 11/1987 |
| JP | 5-202720 | | 8/1993 |
| JP | 8-74534 | | 3/1996 |
| JP | 2004-36560 | | 2/2004 |
| JP | 2004-353599 | | 12/2004 |
| WO | WO 03/008772 | A1 | 1/2003 |

* cited by examiner

LOW VALVE LIFT

HIGH VALVE LIFT

ENGINE VALVE OPERATING SYSTEM

TECHNICAL FIELD

The present invention relates to an engine valve operating system equipped with a variable valve lift mechanism which continuously varies the lift amount of an engine valve, namely an intake valve or exhaust valve.

Background Art

A valve operating system in which one end of a push rod is fitted to one end of a rocker arm having a valve abutment part abutting to an engine valve at the other end side and a link mechanism is provided between the other end of the push rod and a valve operating cam in order to continuously change the amount of lift of the engine valve is already known by Patent Document 1.

However, in the engine valve operating system disclosed in the above-described Patent Document 1, it is necessary to ensure a comparatively large space to dispose a link mechanism and the push rod therein, between the valve operating cam and the rocker arm, and therefore, the valve operating system becomes large in size. In addition, a driving force from the valve operating cam is transmitted to the rocker arm via the link mechanism and the push rod, and therefore, it is difficult to say follow-up ability of the rocker arm to the valve operating cam, namely, follow-up ability of opening and closing operation of the engine valve is excellent.

Thus, the applicant already proposes a valve operating system of the internal combustion engine in which one end portions of a first and second link arm are rotatably connected to a rocker arm, the other end portion of the first link arm is rotatably supported at an engine body, and the other end portion of the second link arm is displaced by drive means in Patent Document 2. According to the valve operating system, it is possible to make the valve operating system compact and it is also possible to ensure excellent follow-up ability to the valve operating cam by directly transmitting the power from the valve operating cam to the rocker arm.

Patent Document 1:

Japanese Patent Application Laid-open No. 8-74534

Patent Document 2:

Japanese Patent Application Laid-open No. 2004-36560

DISCLOSURE OF THE INVENTION

Problems To Be Solved By The Invention

In the above proposed valve operating system, while the rocker arm is driving, in a valve opening direction, the engine valve biased by a spring in a valve closing direction, the valve spring causes the cam abutting portion of the rocker arm to abut against the valve operating cam. However, while the engine valve is closed, the spring force of the valve spring does not act on the rocker arm. Consequently, there is a possibility that the cam abutting portion may leave the valve operating cam to reduce the accuracy with which the valve lift amount is controlled when the engine valve is to be slightly opened.

The present invention has been achieved in view of the above-mentioned circumstances, and has an object to provide an engine valve operating system which continuously varies the lift amount of an engine valve and which is compact in size and ensures follow-up ability of the opening/closing operations, the system also improving the accuracy with which the lift amount is controlled when the engine valve is to be slightly opened.

Means For Solving The Problems

In order to achieve the object, according to a first aspect and feature of the present invention, there is provided an engine valve operating system comprising a rocker arm which has a cam abutting portion abutting against a valve operating cam and is interlocked and connected so as to apply a force in a valve opening direction to an engine valve biased by a valve spring in a valve closing direction, a first link arm having one end turnably connected to the rocker arm and the other end turnably connected at a fixed position of the engine body, a second link arm having one end turnably connected to the rocker arm and the other end turnably supported by a displaceable movable shaft, driving means connected to the movable shaft to enable a position of the movable shaft to be displaced in order to continuously vary the lift amount of the engine valve, and a rocker arm biasing spring which is different from the valve spring and biases the rocker arm in a direction in which the cam abutting portion abuts against the valve operating cam.

In addition to the first feature, according to a second aspect and feature of the present invention, a roller which is the cam abutting portion is axially supported by the rocker arm via a connecting shaft which connects one end of the first link arm to the rocker arm. A locking pin located outside a movable range of the second link arm on a projection of a plane orthogonal to an axis of the movable shaft is installed on a cam holder provided in an engine body so as to rotatably support a cam shaft on which the valve operating cam is provided. One end of the rocker arm biasing spring is engaged with the connecting shaft and the other end of the rocker arm biasing spring is engaged with the locking pin.

In addition to the first feature, according to a third aspect and feature of the present invention, the rocker arm biasing spring is a coil-shaped torsion spring surrounding one of a fixed support shaft and the movable shaft which turnably support the other ends of the first and second link arms.

In addition to the third feature, according to a fourth aspect and feature of the present invention, the driving means is connected to a control shaft formed into a crank-shape and having a pair of crank webs arranged on opposite sides of the second link arm, the movable shaft connecting the crank webs together at right angles, and a support shaft which is connected to the crank webs at right angles at positions offset from the movable shaft and is turnably supported by the engine body. A pair of the crank webs is arranged inward of a pair of the rocker arm biasing springs surrounding the fixed support shaft on opposite sides of the other end of the first link arm.

In addition to the third or fourth feature, according to a fifth aspect and feature of the present invention, a pair of support bosses supporting the fixed support shaft is provided in the engine body so as to sandwich the other end of the first link arm between the support bosses. The rocker arm biasing springs are provided between the engine body and the rocker arm so as to surround the support bosses.

In addition to the fifth feature, according to a sixth aspect and feature of the present invention, a cylindrical fixed support portion is provided at the other end of the first link arm so as to be turnably supported by the fixed support shaft, the fixed support portion having an outer periphery located inward of an outer periphery of each rocker arm biasing spring as viewed laterally. A plurality of projecting portions are provided on opposite ends of the fixed support position at intervals in a circumferential direction so as to stick out from the second end of the first link arm, in order to inhibit the rocker arm biasing springs from being laid down toward the fixed support portion.

Moreover, in addition to the sixth feature, according to a seventh feature of the present invention, the projecting portions are arranged outside an operating range of the second link arm.

Effect Of The Invention

With the first feature of the present invention, the lift amount of the engine valve can be continuously varied by continuously displacing the movable shaft. Further, since one end of each of the first and second link arms is turnably connected directly to the rocker arm. This allows a reduction in the size of the space in which the link arms are arranged, and in the size of the valve operating system. Furthermore, power from the valve operating cam is transmitted directly to the cam abutting portion of the rocker arm. This ensures excellent follow-up ability to the valve operating cam. Moreover, the rocker arm is biased by the rocker arm biasing springs which are different from the valve spring in the direction in which the cam-abutting portion is abutted against the valve operating cam. This prevents the cam abutting portion of the rocker arm from leaving the valve operating cam even while the engine valve is closed. It is therefore possible to increase the accuracy with which the valve lift amount is controlled when the engine valve is slightly opened.

With the second feature of the present invention, the rocker arm biasing springs can be arranged while reliably avoiding interference with the second link arm.

With the third feature of the present invention, the rocker arm biasing springs that are coil-shaped torsion springs are arranged so as to surround one of the fixed support shaft and movable shaft which turnably support the other ends of the first and second link arms. This reduces the space for installing the rocker arm biasing springs to make the valve operating system compact in size.

With the fourth feature of the present invention, the crank-shaped control shaft turnably driven by the driving means around the axis of the support shaft is partly formed of the movable support shaft. This facilitates the displacement of the movable shaft to simplify a mechanism which uses the driving means to displace the movable shaft. Further, the control shaft can be placed as close to the fixed support shaft as possible. This serves to reduce the size of the valve operating system.

With the fifth feature of the present invention, the pair of support bosses avoids the effect of contraction of the rocker arm biasing springs on the rocker shaft, while regulating the movement of the other end of the first link arm, and enabling the rocker arm biasing springs to be arranged in compact form.

With the sixth aspect of the present invention, by using the projecting portions which avoid the rocker arm biasing springs from being laid down toward the fixed support portion, it is possible to improve the support rigidity of the fixed support portion, while avoiding an increase in the size of the fixed support portion.

Moreover, with the seventh feature of the present invention, even though the projecting portions are provided on the fixed support portion, a sufficient operating range can be provided for the second link arm.

DESCRIPTION OF REFERENCE NUMERALS AND CHARACTERS

Figure 1:
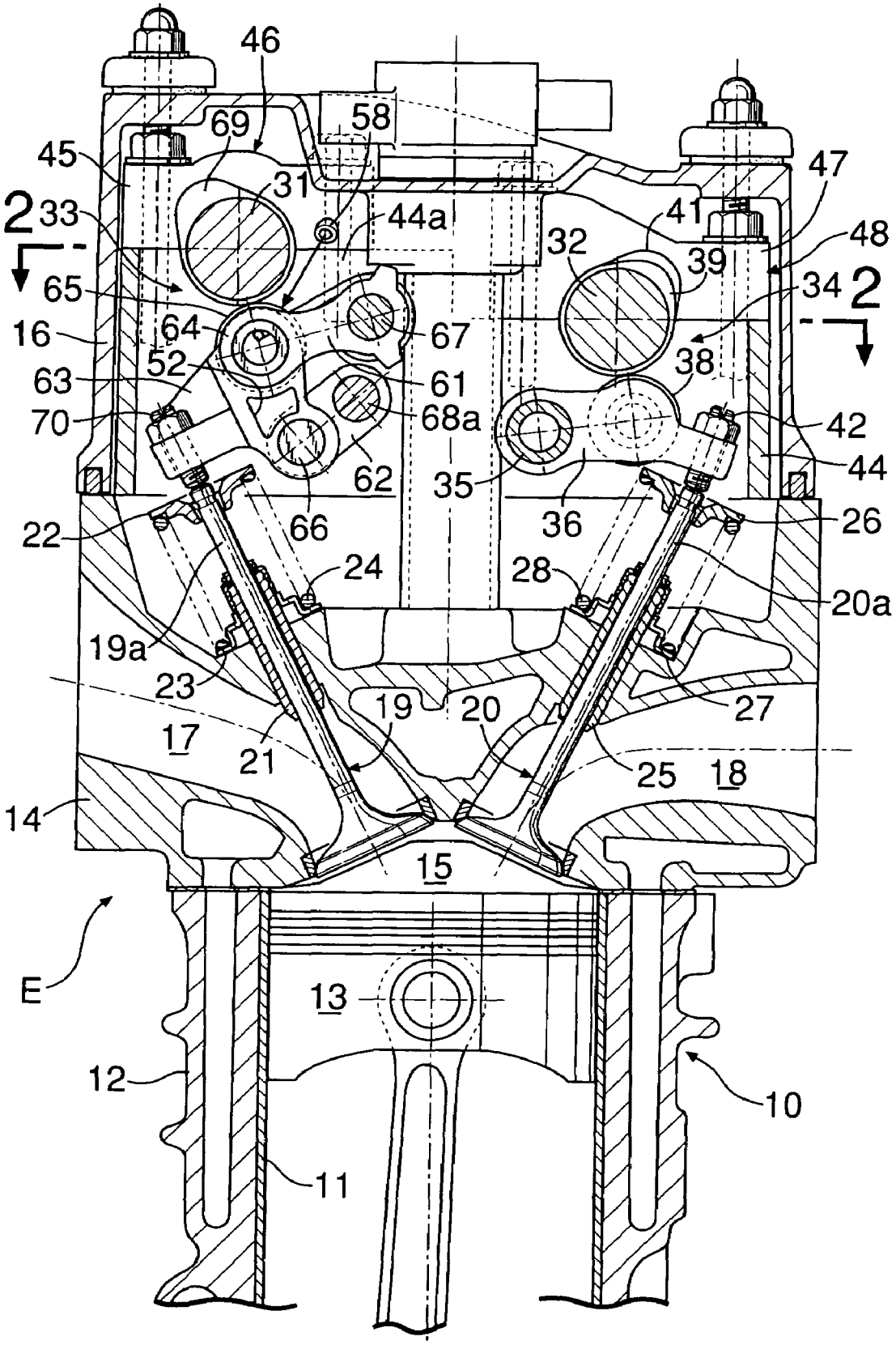
FIG. 1 is a partial longitudinal sectional view of an engine taken along line 1-1 in FIG. 2. (Embodiment 1)

10 . . . Engine body
19 . . . Intake valve that is an engine valve
24 . . . Valve spring
46 . . . Cam holder
53 . . . Support boss
54 . . . Rocker arm biasing spring
55 . . . Locking pin
56, 57 . . . Projecting portions
61 . . . First link arm
61*b* . . . Fixed support portion
62 . . . Second link arm
63 . . . Rocker arm
64 . . . Connecting shaft
65 . . . Roller as a cam abutting portion
67 . . . Fixed support shaft
68*a* . . . Movable shaft
68*b* . . . Crank web
68*c* . . . Support shaft
68 . . . Control shaft
69 . . . Valve operating cam
72 . . . Actuator motor as driving means
E . . . Engine

Best Mode For Carrying Out The Invention

A mode for carrying out the present invention will be described based on an embodiment of the present invention shown in the accompanied drawings.

Embodiment 1

FIGS. 1 to 12 show one embodiment of the present invention. First, in FIG. 1, an engine body 10 of an in-line multi-cylinder engine E comprises a cylinder block 12 with cylinder bores 11 in the interior, a cylinder head 14 joined to a top face of the cylinder block 12, and a head cover 16 joined to a top face of the cylinder head 14. Pistons 13 are slidably fitted in the cylinder bores 11. Combustion chambers 15 facing tops of the pistons 13 are formed between the cylinder block 12 and cylinder head 14.

The cylinder head 14 is equipped with intake ports 17 and exhaust ports 18 which can communicate with combustion chambers 15. The intake ports 17 are opened and closed by a pair of intake valves 19, 19 which are engine valves while the exhaust ports 18 are opened and closed by a pair of exhaust valves 20, 20. Each intake valve 19 has a stem 19*a* slidably fitted in a valve guide 21 provided in the cylinder head 14, and is biased in a valve closing direction by a valve spring 24 installed between a spring seat 22 provided at the upper end of the stem 19*a* and a spring seat 23 abutted by the cylinder head 14. Each exhaust valve 20 has a stem 20*a* slidably fitted in a valve guide 25 provided in the cylinder head 14 and is biased in a valve closing direction by a valve spring 28 installed between a spring seat 26 provided at the upper end of the stem 20*a* and a spring seat 27 abutted by the cylinder head 14.

Figure 2:
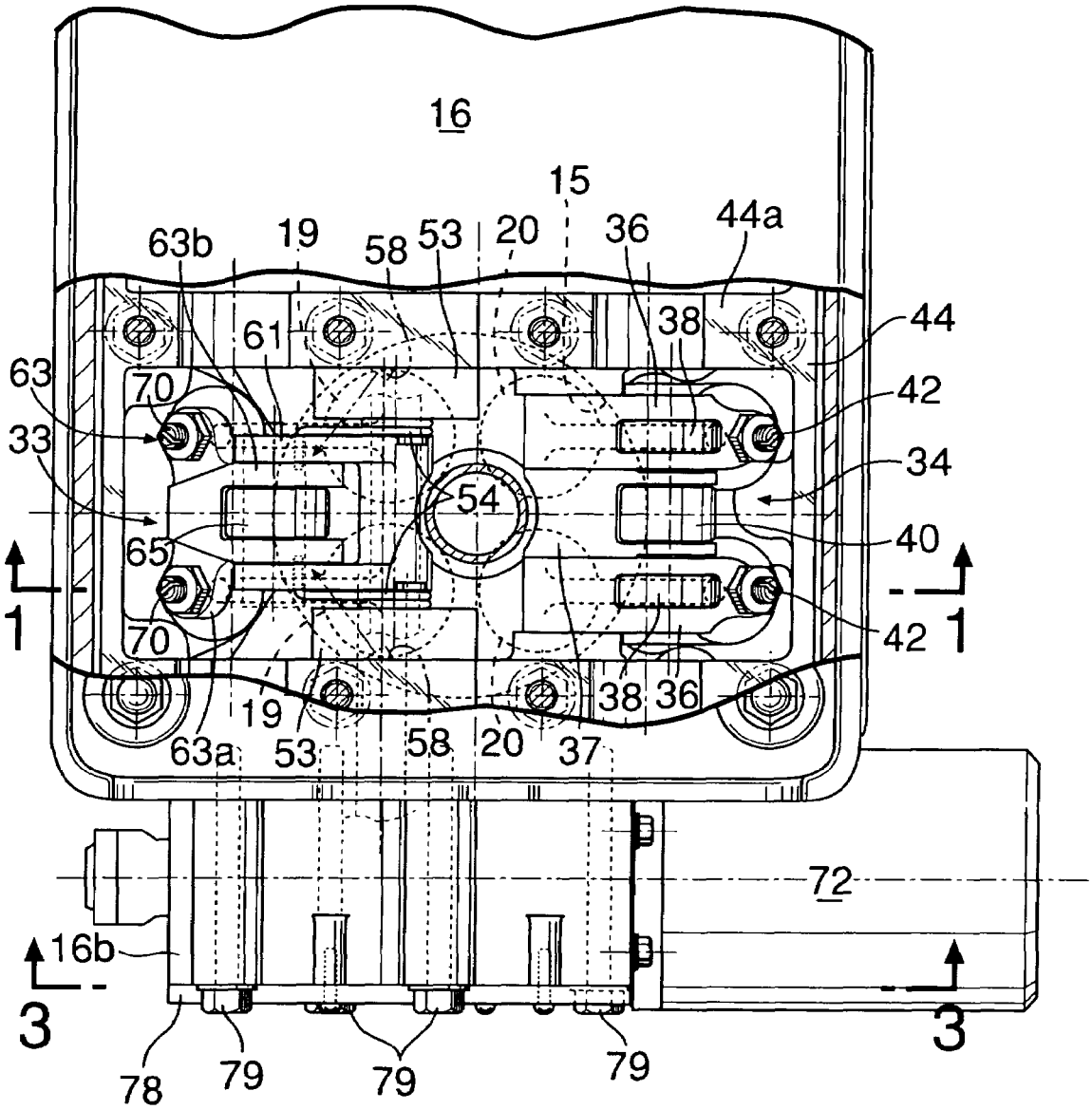
FIG. 2 is a sectional view taken along line 2-2 in FIG. 1. (Embodiment 1)

Referring also to FIG. 2, the cylinder head 14 integrally comprises a holder 44 which has supporting walls 44*a* placed on opposite sides of each cylinder. Caps 45 and 47 are coupled to each supporting wall 44*a* to form an intake cam holder 46 and exhaust cam holder 48 in conjunction. Consequently, an intake camshaft 31 is rotatably supported by the intake cam holders 46 while an exhaust camshaft 32 is rotatably supported by the exhaust cam holders 48. The intake valves 19 are driven by the intake camshaft 31 via variable lifting mechanism 33. The exhaust valves 20 are driven by the exhaust camshaft 32 via variable valve timing/lifting means 34.

The variable timing/lifting means 34 which drives the exhaust valves 20 is well-known, and will only be outlined here. A pair of low-speed rocker arms 36, 36 and one high-speed rocker arm 37 are pivotably supported at their first ends on an exhaust rocker arm shaft 35 supported by holding walls 44*a* of exhaust cam holders 48. Two low speed cams 39, 39 provided on the exhaust camshaft 32 abut rollers 38, 38 axially supported in intermediate parts of the low-speed rocker arms 36, 36. A high speed cam 41 provided on the exhaust camshaft 32 abuts against a roller 40 axially supported in an intermediate part of the high-speed rocker arm 37. Tappet screws 42 which abut against the upper ends of the stems 20*a* of the exhaust valves 20 are screwed into the second ends of the low speed rocker arms 36 in such a way as to allow their advance/retract position to be adjusted.

The low speed rocker arms 36, 36 and the high speed rocker arm 37 can be connected and disconnected by hydraulic control. When the engine E is running at low speed, if the low speed rocker arms 36, 36 and the high speed rocker arm 37 are disconnected, the low speed rocker arms 36, 36 are driven by the corresponding low speed cams 39, 39. Consequently, the exhaust valves 20, 20 are opened and closed with a low valve lift and a low opening angle. On the other hand, when the engine E is running at high speed, if the low speed rocker arms 36, 36 and the high speed rocker arm 37 are connected, the high speed rocker arm 37 is driven by the corresponding high speed cam 41. Consequently, the exhaust valves 20, 20 are opened and closed with a high valve lift and a high opening angle by the low speed rocker arms 36, 36 coupled to the high speed rocker arm 37. In this way, the valve lift and valve timing of the exhaust valves 20, 20 are controlled at two levels by the variable timing/lifting means 34.

Now, the structure of the variable lifting mechanism 33 will be described by referring also to FIGS. 3 to 8. The variable lifting mechanism 33 comprises a rocker arm 63 having a roller 65 serving as a cam abutting portion which abuts against a valve operating cam 69 provided on the intake cam shaft 31, a first link arm 61 having a first end turnably connected to the rocker arm 63 and a second end turnably supported at a fixed position of the engine body 10, and a second link arm 62 having a first end turnably connected to the rocker arm 63 and a second end turnably supported by a displaceable movable shaft 68*a*.

The rocker arm 63 is provided at its first end with a valve connecting portion 63*a* into which tappet screws 70, 70 are screwed in such a way as to allow advance/retract positions of the screws to be adjusted; the tappet screws 70, 70 abut against the upper ends of the stems 19*a* of the pair of intake valves 19 from above. The second end of the rocker arm 63 is formed into a general U shape, opening in opposition to the intake valves 19. The second end of the rocker arm 63 is provided with a first support portion 63*b* to which a first end of the first link arm 61 is turnably connected and a second support portion 63*c* to which a first end of the second link arm 61 is turnably connected; the second support portion 63*c* is placed below the first support portion 63*b*. Further, a roller 65 is placed so as to be sandwiched between linear portions of a generally U-shaped first support portion 63*b*; the roller 65 serves as a cam-abutting portion placed in rolling contact with the valve operating cam 69 of the intake cam shaft 31. The roller 65 is axially supported by the first support portion 63*b* coaxially with a first end connecting portion of the first link arm 61.

Further, the rocker arm 63 is formed so that the valve connecting portion 63*a* have a width larger than that of the remaining part in a direction along a turning axis of the valve operating cam 69. The first and second support portions 63*b* and 63*v* are formed to have the same width.

The first link arm 61 is formed into a substantial U shape with a pair of first connecting portions 61*a*, 61*a* which sandwiches the rocker arm 63 between them, a cylindrical fixed support portion 61*b*, and a pair of arm portions 61*c*, 61*c* which link the first connecting portions 61*a*, 61*a* and the fixed support portion 61*b*.

The first connecting portions 61*a*, 61*a* at the first end of the first link arm 61 are turnably connected to the first support portion 63*b* of the rocker arm 63 via a cylindrical first connecting shaft 64 fixedly inserted into a first connecting hole 49 formed in the first support portion 63*b* of the rocker arm 63. The roller 65 is axially supported by the first support portion 63*b* via a needle bearing 60 and the first connecting shaft 64. Further, an outer flank of that part of the first support portion 63*b* which is opposite the intake cam shaft 31 overlaps with outer flanks of the first connecting portions 61*a*, 61*a* of the first link arm 61, as viewed laterally; an arc shape is thus formed around the axis of the first connecting shaft 64.

The second link arm 62 is placed below the first link arm 61. The second link arm 62 has a first connecting portion 62*a* at its first end and a movable support portion 62*b* at its second end. A second connecting portion 62*a* is placed so as to be sandwiched between linear portions of the generally U-shaped second support portion 63*b*. A second support portion 63*c* is provided not only with the first connecting hole 49 of the first support portion 63*b* but also with a second connecting hole 50 located by the side of the first connecting hole 49 in a direction in which both intake valves 19 are opened and closed, that is, in the vertical direction. The second connecting portion 62*a* is turnably connected to the second support portion 63*c* via a second connecting shaft 66 fixedly inserted into the second connecting hole 50.

The first end of the rocker arm 63 having the roller 65 above the second end abutting against the valve operating cam 69 is interlocked with and connected to the pair of intake valves 19. The first connecting portions 61*a*, 61*a* provided at the first end of the upper first link arm 61 and the second connecting portion 62*a* provided at the first end of the second link arm 62, located below the first link arm 61, are vertically arranged in parallel and relatively turnably connected to the second arm of the rocker arm 63.

The rocker arm 63 is provided integrally with a pair of connecting walls 63*d* that links the generally U-shaped first and second support portions 63*b* and 63*c* together. The connecting walls 63*d* are formed so as to connect the first and second support portions 63*b* and 63*c* together; the connecting walls 63*d* are at least partly arranged opposite the intake valves 19 with respect to a tangent L which contacts with outer edges of the first and second connecting holes 49 and 50 on the side of both intake valves 19.

Concave portions 51 are formed in the connecting walls 63*d* so as to lie opposite the movable shaft 68*a* when the movable support portion 62*b* at the second end of the second link arm 62 is closest to the rocker arm 63. Moreover, lightening portions 52 are formed in the connecting walls 63*d* so as to be recessed from an outer surface to inner surface of each wall.

The fixed support portion 61*b* at the second end of the first link arm 61 is turnably supported by a fixed support shaft 67 fixedly supported by a support walls 44*a* constituting the lower part of the intake cam holders 46 provided in the engine body 10.

Figure 6:
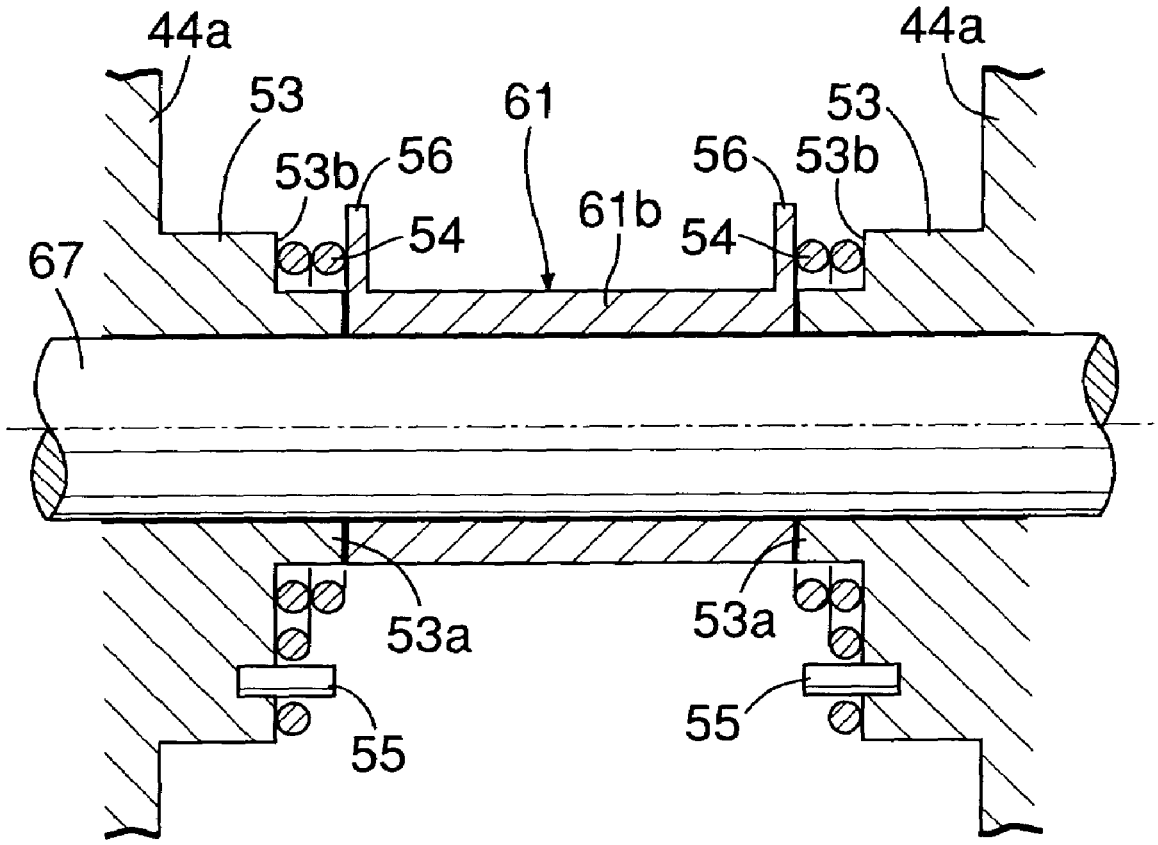
FIG. 6 is an enlarged sectional view taken along line 6-6 in FIG. 4. (Embodiment 1)

Referring particularly to FIG. 6, a pair of support bosses 53, 53 stick out integrally from the support walls 44*a* so as to sandwich the fixed support portion 61*b* of the first link arm 61 in an axial direction. Each of the support bosses 53 is provided with a smaller-diameter shaft portion 53*a* which can slidably contact with the opposite end faces of the fixed support portion 61*b* and a step portion 53*b* located opposite and away from the opposite end faces of the fixed support portion 61*b* so as to surround a proximal end of the smaller-diameter shaft portion 53*a*. The fixed support shaft 67 is fixedly supported by the support bosses 53 so as to coaxially penetrate the smaller-diameter shaft portions 53*a*.

Both intake valves 19 are biased by the valve springs 24 in the valve closing direction. While the rocker arm 63 is driving, in the valve opening direction, both intake valves 19 biased in the valve closing direction, the valve springs 24 cause the roller 65 of the rocker arm 63 to abut against the valve operating cam 69. However, while the intake valves 19 are closed, the spring force of the valve springs 24 does not act on the rocker arm 63. Consequently, the roller 65 may leave the valve operating cam 69 to reduce the accuracy with which the valve lift amount is controlled when the intake valves 19 are to be slightly opened. Thus, the rocker arm biasing springs 54, which are different from the valve springs 24, are used to bias the rocker arm 63 in a direction in which the roller 65 abuts against the valve operating cam 69.

The rocker arm biasing springs 54 are coil-shaped torsion springs surrounding one of the fixed support shaft 67 and movable shaft 68*a* which turnably support the fixed support portion 61*b* and movable support portion 62*b*, which are the second ends of the first and second link arms 61 and 62. In the present embodiment, the rocker arm biasing springs 54 are arranged so as to surround the fixed support shaft 67 via the smaller-diameter shaft portions 53*a* of the support bosses 53, which stick out from the support wall portion 44*a* of the intake cam holder 46, and provided between the engine body 10 and the rocker arm 63. In other words, the first end of each rocker arm biasing spring 54, surrounding the smaller-diameter shaft portion 53*a*, is engaged with a locking pin 55 installed on the step portion 53*b* of the support boss 53 in the intake cam holder 46. The second end of the rocker arm biasing spring 54 is inserted into and engaged with a hollow first connecting shaft 64 which operates integrally with the rocker arm 63. The locking pin 55 is installed on the step portion 53*b* of the support boss 53 so as to lie outside the movable range of the second link arm 62 on a projection of a plane (which is parallel to the sheet of FIG. 4) orthogonal to the axis of the movable shaft 68*a*.

The fixed support portion 61*b* at the second end of the first link arm 61 is formed into a cylinder so that its outer periphery is placed inward of an outer periphery of each rocker arm biasing spring 54 as viewed laterally, the rocker arm biasing spring being wound in a coil shape. A plurality of, for example, paired projecting portions 56 and 57 are provided away from each other in a circumferential direction so as to stick out from the opposite ends of the fixed support portion 61*b* in its axial direction. The projecting portions 56 and 57 serve to inhibit the rocker arm biasing springs 54 from being laid down toward the fixed support portion 61*b*. The projecting portions 56 and 57 are arranged outside the operating range of the second link arm 62.

Oil jets 58 are fixedly placed in the engine body 10 as oil supply means to supply oil to the upper one of the first and second connecting shafts 64 and 66 arranged at the second end of the rocker arm 63 vertically in parallel so as to connect the first connecting portions 61*a* and second connecting portion 62*a* together, which are provided at the first ends of the first and second link arm 61 and 62. In the present embodiment, the oil jets 58 are fixedly attached to caps 45 of the intake cam holders 46, provided in the engine body 10, to supply oil to the first connecting shaft 64, one of the first and second connecting shafts 64 and 66.

Further, the first support portion 63*b* is provided in the upper part of the second end of the rocker arm 63; the first support portion 63*b* is formed into a substantially U-shape so as to sandwich the roller 65 between its linear portions. The first connecting portions 61*a* of the first link arm 61 are turnably connected to the first support portion 63*b* via the first connecting shaft 64, which axially supports the roller 65. The oil jets 58 are disposed in the caps 45 so as to supply oil to mating surfaces of the first connecting portions 61*a* of the first link arm 61 and the first support portion 63*b*.

Figure 7:
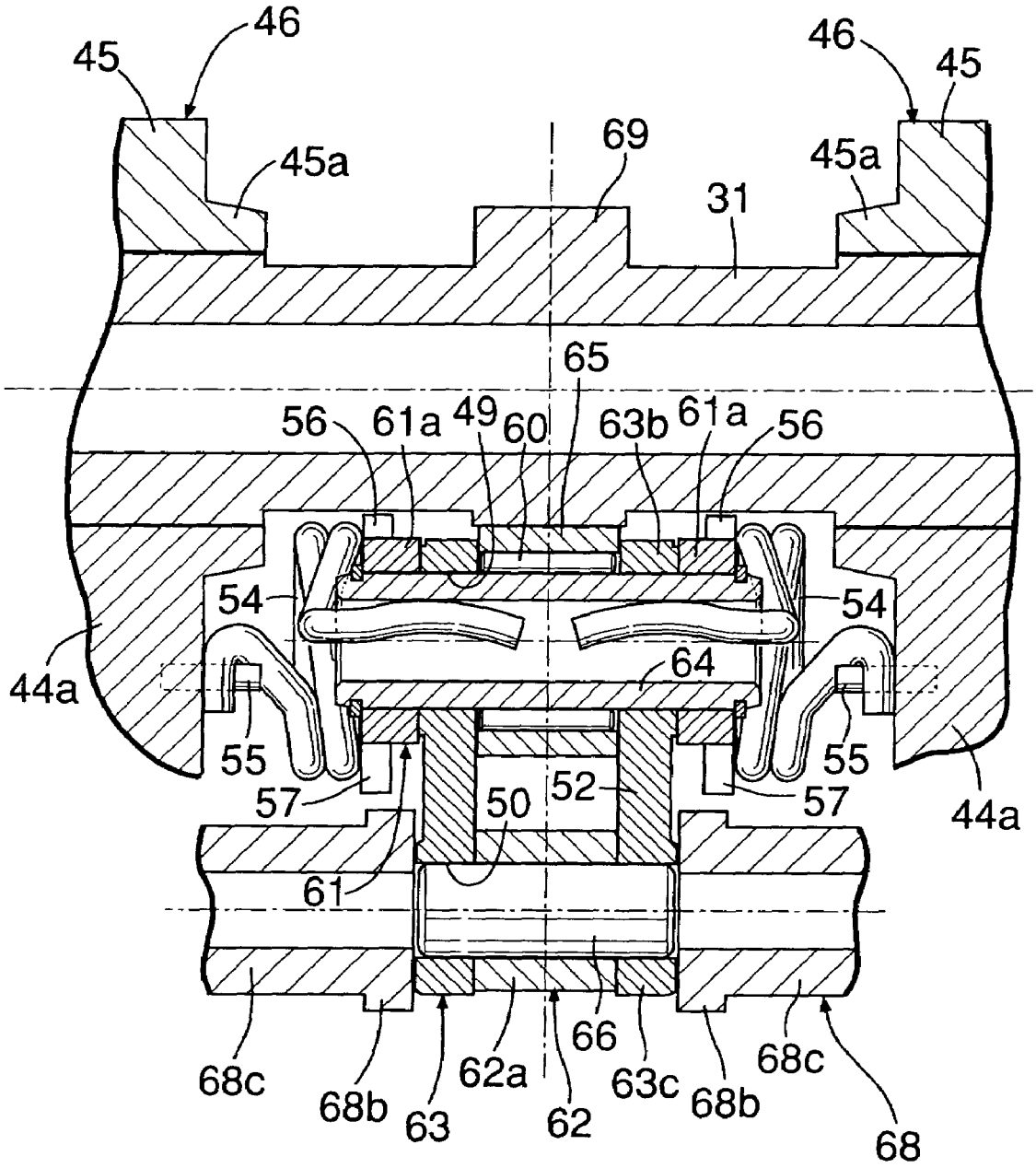
FIG. 7 is a sectional view taken along line 7-7 in FIG. 4. (Embodiment 1)
Figure 8:
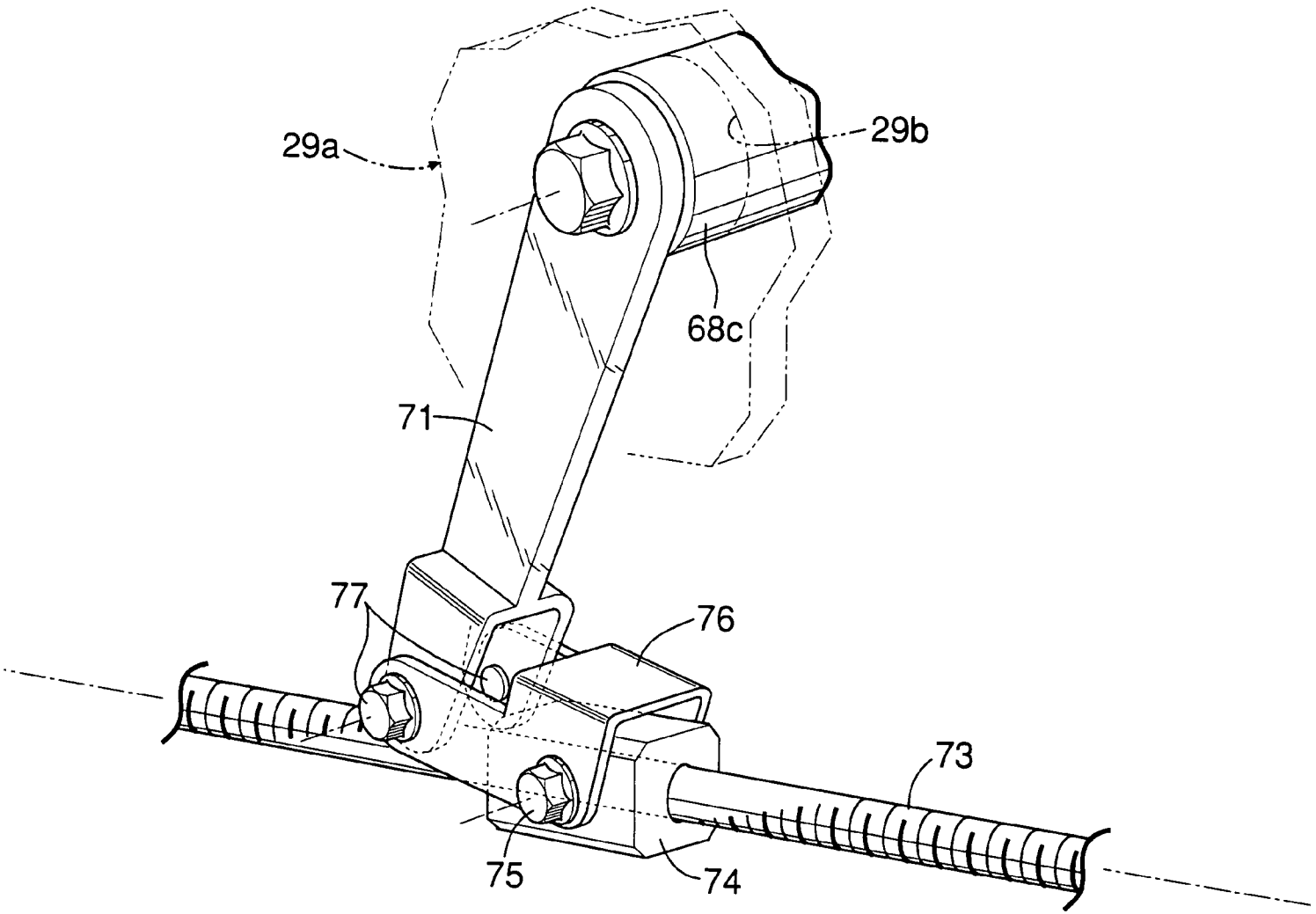
FIG. 8 is a view along arrow 8 in FIG. 3. (Embodiment 1)

Referring also to FIG. 7, the control shaft 68 is provided with the movable shaft 68*a* turnably supporting the movable support portion 62*b*, provided at the second end of the second link arm 62. The control shaft 68 is formed into a crank-shape and has a pair of crank webs 68*b*, 68*b* arranged on the opposite sides of the second link arm 62, the movable shaft 68*a* connecting the crank webs 68*b*, 68*b* together at right angles, and a support shaft 68*c* which is connected to the crank webs 68*b* at right angles at positions offset from the movable shaft 68*a* and which is turnably supported by the engine body 10.

Cam shaft support boss portions 45*a* penetrating the intake cam shaft 31 are formed on the support walls 44*a* and caps 45 so as to stick out toward the rocker arms 63; the support walls 44*a* and caps 45 are coupled together so as to form the intake cam holders 44 in conjunction.

The crank webs 68*b*, 68*b* of the control shaft 68 are arranged inward of a pair of the rocker arm biasing springs 54, 54 surrounding the fixed support shaft 67 on opposite sides of the second end of the first link arm 61. The support shaft 68*c* at the first end of the control shaft 68, extending along a direction in which cylinders are arranged, is rotatably supported in a support hole 16*a* formed in a head cover 16 in the engine body 10 as shown in FIG. 5.

Figure 4:
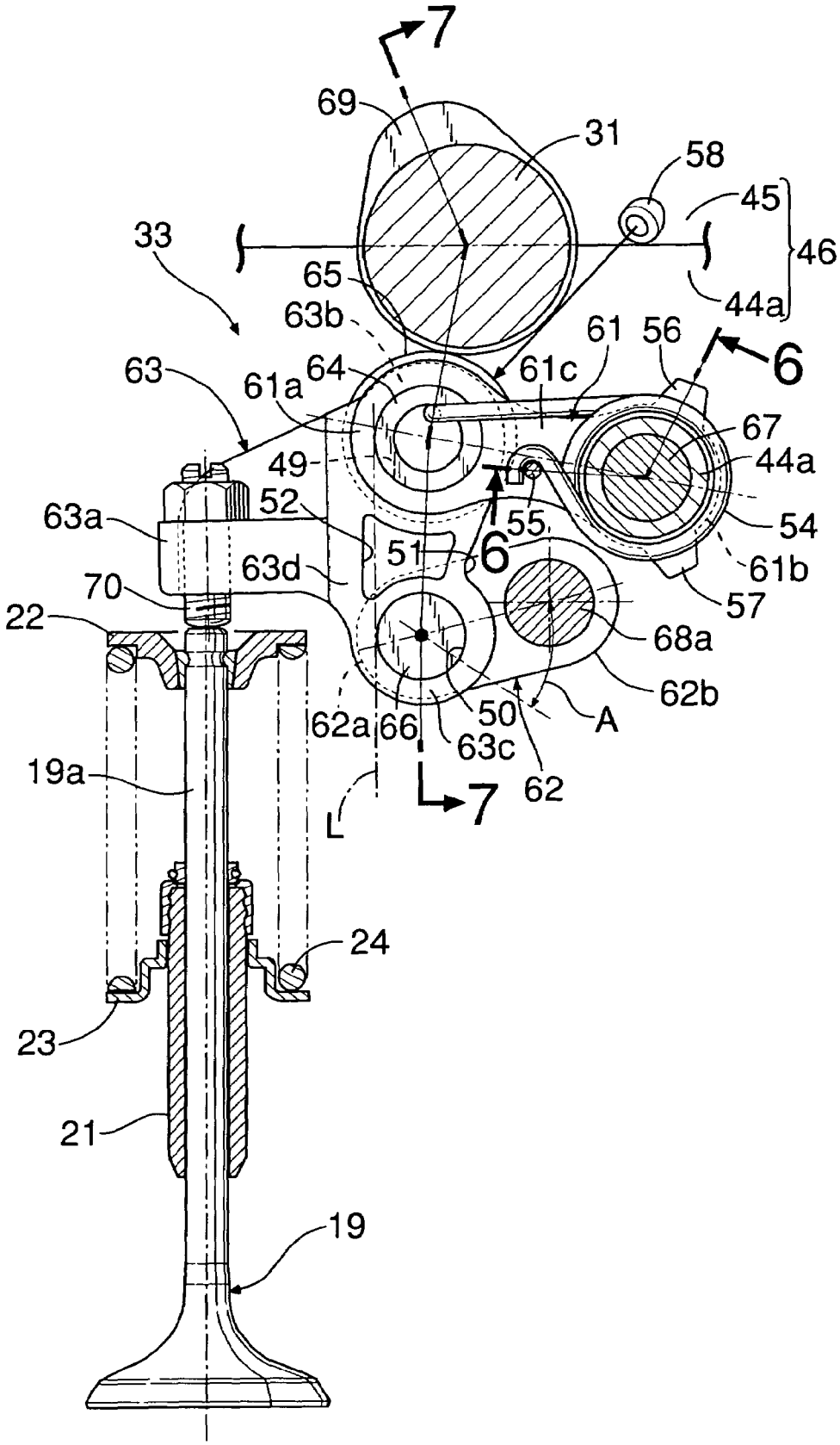
FIG. 4 is a side view of variable lifting mechanism. (Embodiment 1)
Figure 5:
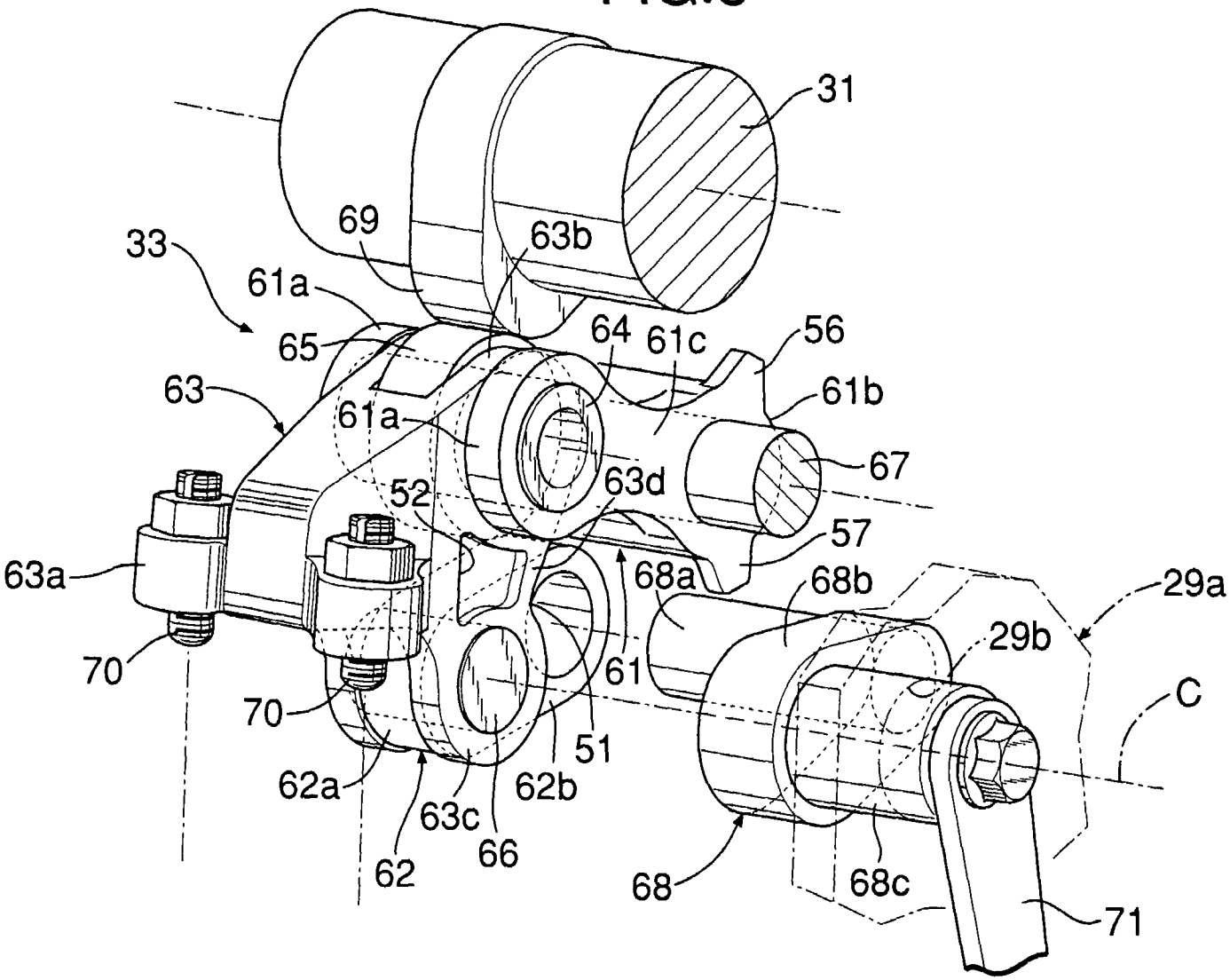
FIG. 5 is an exploded perspective view of the variable lifting mechanism. (Embodiment 1)

When the rocker arm 63 is at the raised position shown in FIG. 4, that is, when the intake valves 19 are in a closed state, the spindle 68*c* of the control shaft 68 is placed coaxially with an axis C of a second connecting shaft 66, which pivotably supports the lower part of the rocker arm 63 (see FIG. 5). Therefore, when the control shaft 68 swings around the axis of the spindle 68*c*, the movable support shaft 68*a* moves on an arc A (see FIG. 4) which has its center at the spindle 68*c*.

The spindle 68*c* of the control shaft 68 sticks out from the support hole 16*a* in the head cover 16. A control arm 71 is fixed to the tip of the spindle 68*c* and driven by an actuator motor 72 mounted on an outer wall of the cylinder head 14 and serving as drive means. That is, a nut member 74 meshes with a threaded shaft 73 rotated by the actuator motor 72. A first end of a connecting link 76 is pivotably supported on the nut member 74 via a pin 75. The second end is connected to the control arm 71 via pins 77, 77. Therefore, when the actuator motor 72 is operated, the nut member 74 moves along the rotating threaded shaft 73. Further, the crank member 68 is caused to swing around the spindle 68*c* by the control arm 71 connected to the nut member 74 via the connecting link 76. Consequently, the movable shaft 68*a* moves between the position shown in FIG. 9A and the position shown in FIG. 9B.

A rotational angle sensor 80 such as a rotary encoder is installed on an outer wall surface of the head cover 16. A first end of a sensor arm 81 is fixed to the tip of a sensor shaft 80*a* of the rotational angle sensor 80. A guide groove 82 is provided in the control arm 71 linearly extending along its length. A connecting shaft 83 mounted on a second end of the sensor arm 81 is slidably fitted in the guide groove 82.

The threaded shaft 73, nut member 74, pin 75, connecting link 76, pins 77, 77, control arm 71, rotational angle sensor 80, sensor arm 81, and connecting shaft 83 are housed within wall portions 14*a* and 16*b* sticking out from flanks of the cylinder block 14 and head cover 16. A cover 78 which covers end faces of the wall portions 14*a* and 16*b* is fixed to the wall portions 14*a* and 16*b* with bolts 79.

Figure 3:
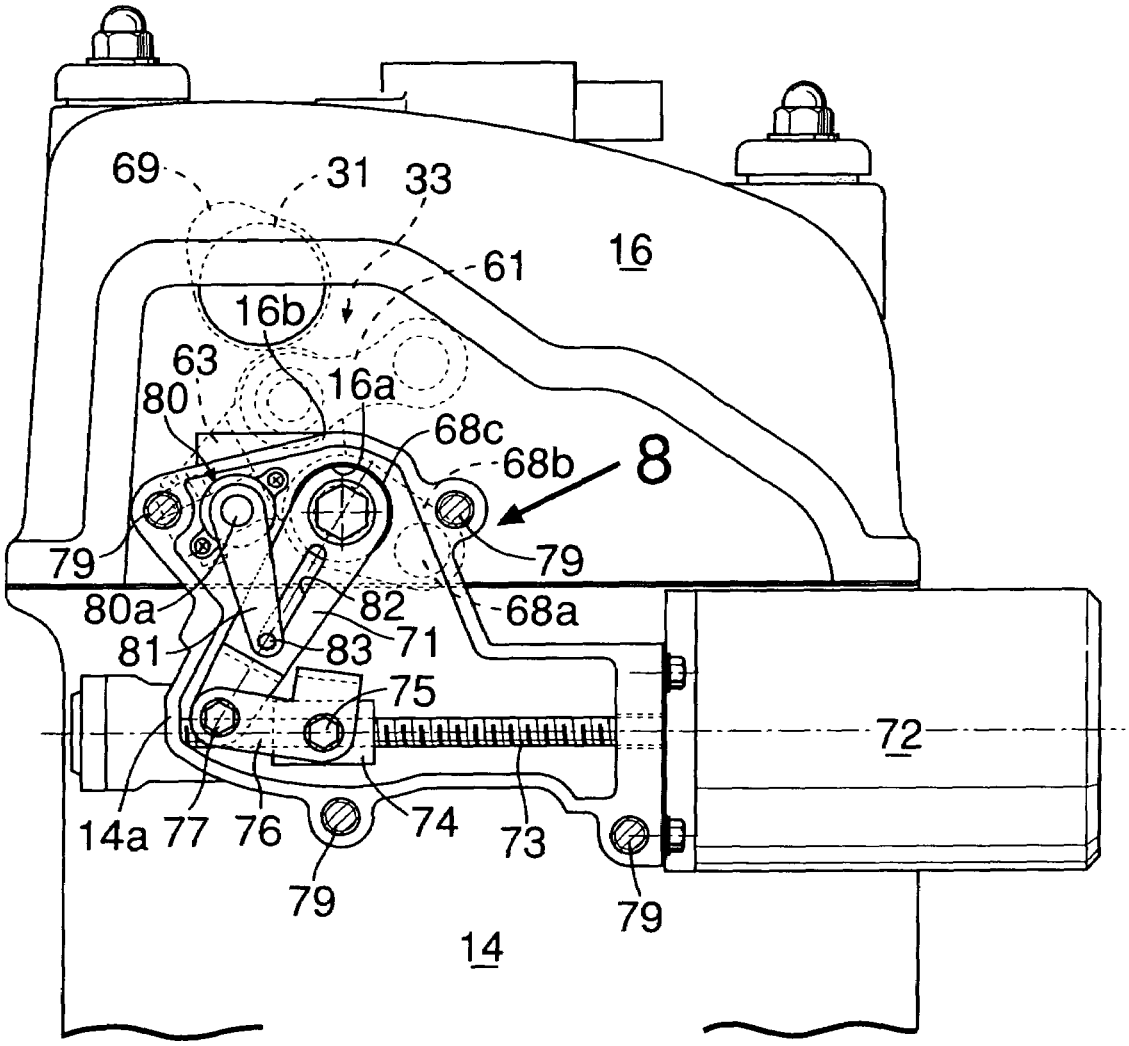
FIG. 3 is a view taken along line 3-3 in FIG. 2. (Embodiment 1)
Figure 9B:
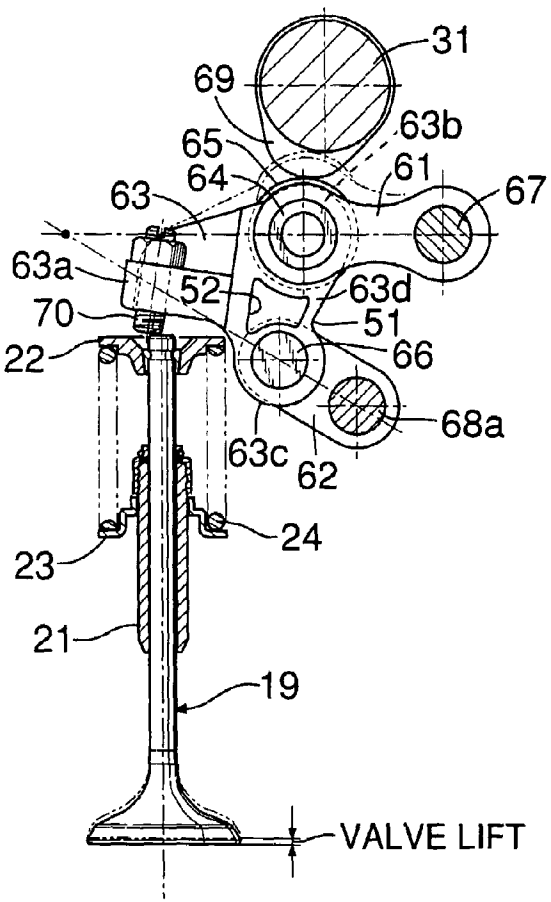
FIG. 9B is an explanatory diagram illustrating operation of the variable lifting mechanism when the valve lift is low. (Embodiment 1)
Figure 9A:
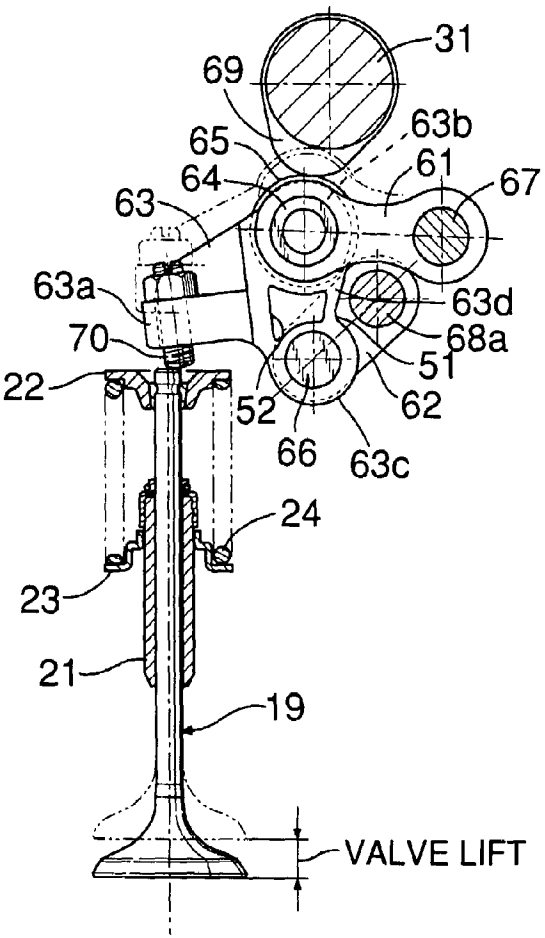
FIG. 9A is an explanatory diagram illustrating operation of the variable lifting mechanism when the valve lift is high. (Embodiment 1)

In the variable lifting mechanism 33, when the control arm 71 is turned counterclockwise by the actuator motor 72 from the position indicated by the solid line in FIG. 3, the control shaft 68 (see FIG. 5) connected to the control arm 71 turns counterclockwise. The movable shaft 68*a* of the control shaft 68 then ascends as shown in FIG. 9A. When the valve operating cam 69 mounted on the intake camshaft 31 pushes the roller 65 in this state, a four-bar link joining the fixed support shaft 67, first connecting shaft 64, second connecting shaft 68, and movable support shaft 68*a* deforms. This causes the rocker arm 63 to swing downward from the chain-line position to the solid-line position. The tappet screws 70, 70 then push the stems 19*a* of the intake valves 19. The intake valves 19 are thus opened with a high valve lift.

When the control arm 71 is turned to the solid-line position in FIG. 3 by the actuator motor 72, the control shaft 68 connected to the control arm 71 turns clockwise. The moveable shaft 68*a* of the control shaft 68 descends as shown in FIG. 9B. When the valve operating cam 69 mounted on the intake camshaft 31 pushes the roller 65 in this state, the four-bar link deforms. This causes the rocker arm 63 to swing downward from the chain-line position to the solid-line position. The tappet screws 70, 70 then push the stems 19*a* of the intake valves 19. The intake valves 19 are thus opened with a low valve lift.

Figure 10:
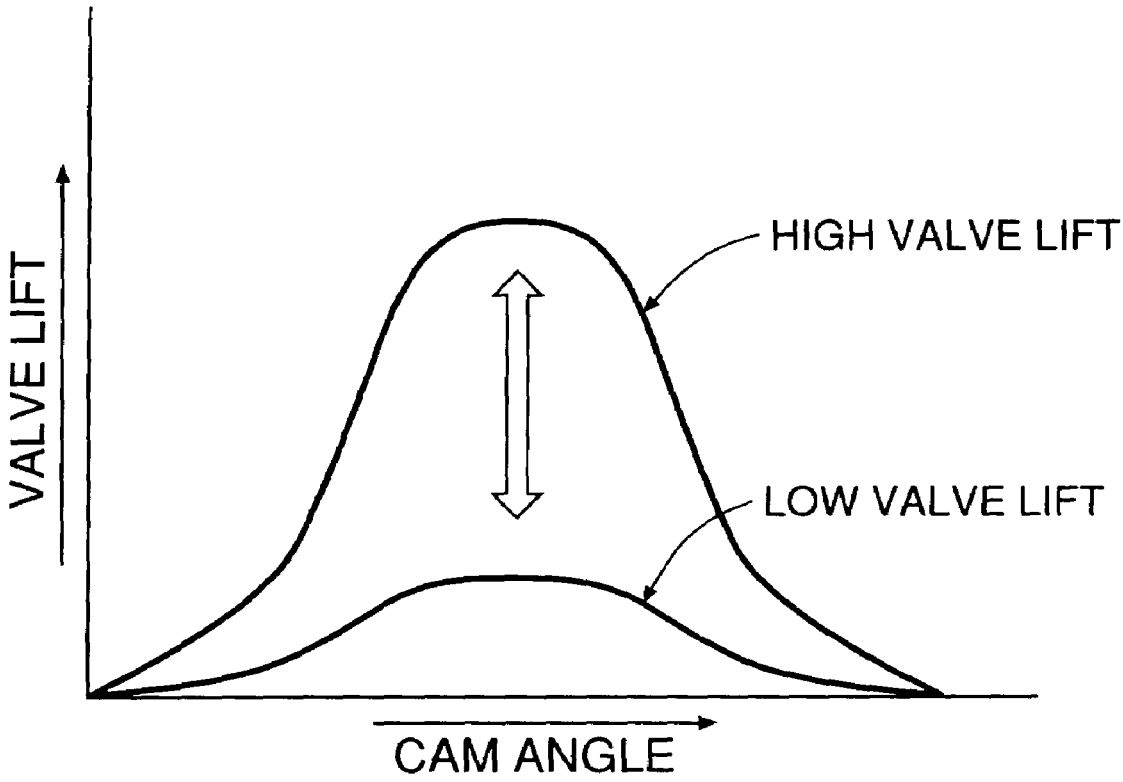
FIG. 10 is a diagram showing a lift curve of an engine valve. (Embodiment 1)

FIG. 10 is a diagram showing a lift curve of the intake valve 19. The opening angle with the high lift corresponding to FIG. 9A is the same as that with the low lift corresponding to FIG. 9B, and only the amount of lift has changed. In this way, the variable lifting mechanism 33 allows only the lift amount to be changed freely without changing the opening angle of the intake valves 19.

When changing the lift of the intake valves 19 by swinging the control shaft 68 using the actuator motor 72, it is necessary to detect the magnitude of the lift, i.e., the rotational angle of the spindle 68*c* of the control shaft 68 and feed this data back for use in controlling the actuator motor 72. To achieve this, the rotational angle sensor 80 detects the rotational angle of the spindle 68*c* of the control shaft 68. To simply detect the rotational angle of the spindle 68*c* of the control shaft 68, the rotational angle sensor 80 can be connected directly to the spindle 68*c*. However, since the intake efficiency changes greatly with only a slight change in the amount of lift in the low lift region, it is necessary to detect the rotational angle of the spindle 68*c* of the control shaft 68 accurately and feed this data back for use in controlling the actuator motor 72. On the other hand, in a high lift region, since the intake efficiency does not change greatly even when the amount of lift changes to some extent, high accuracy is not required to detect the rotational angle.

Figure 11:
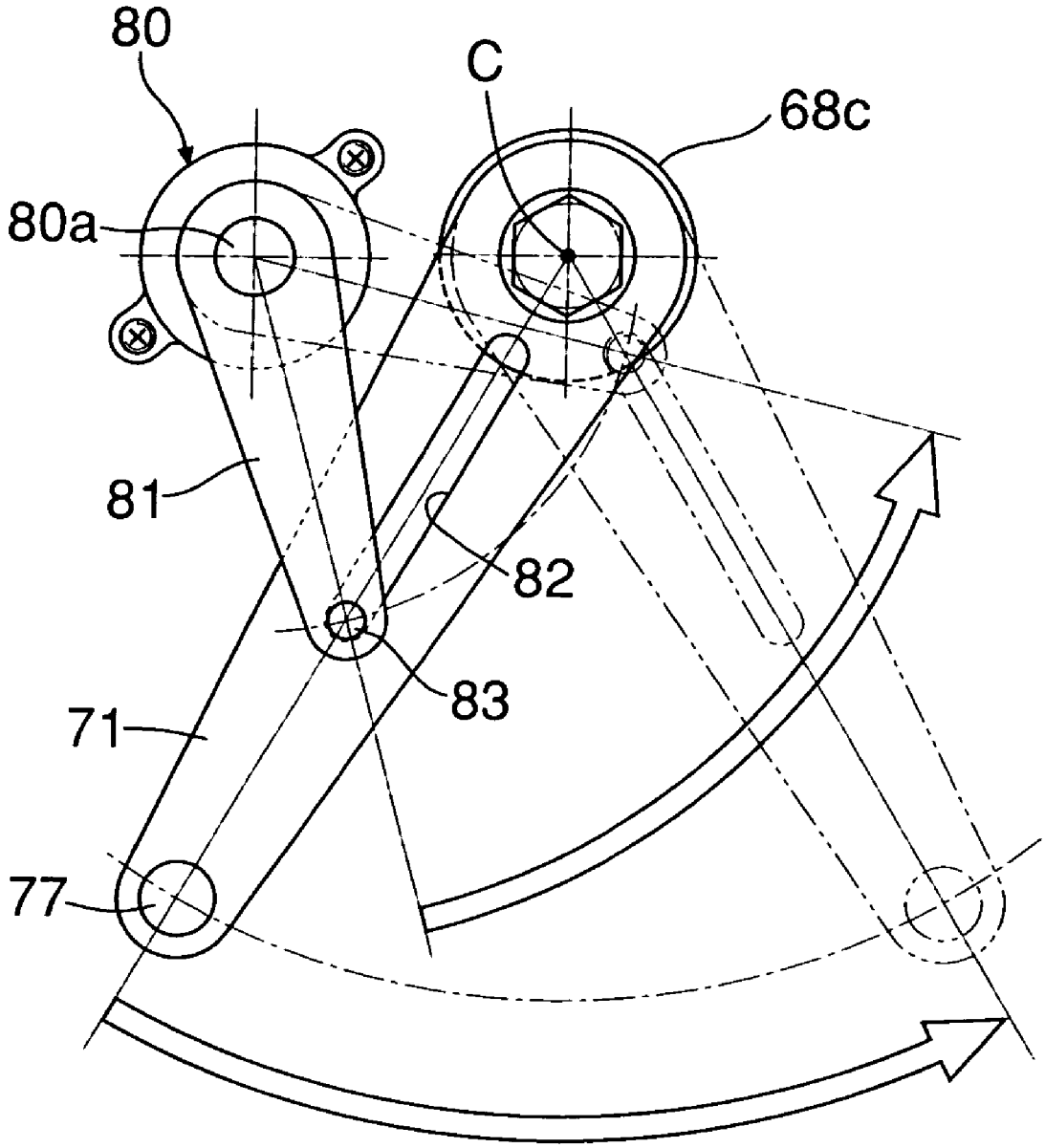
FIG. 11 is an enlarged view of essential part of FIG. 3. (Embodiment 1)

The position of the control arm 71 indicated by the solid line in FIG. 11 corresponds to the low lift region. The position of the control arm 71 indicated by the chain line in the anticlockwise direction away from the low lift region corresponds to the high lift region. In the low lift region, since the connecting shaft 83 of the sensor arm 81 fixed to the sensor shaft 80*a* of the rotational angle sensor 80 is engaged with the tip side (the side farther from the axis C) of the guide groove 82 of the control arm 71, even a slight swing of the control arm 71 results in a large swing of the sensor arm 81. This magnifies the ratio of the rotational angle of the sensor shaft 80*a* relative to the rotational angle of the control shaft 68. The resolution of the rotational angle sensor 80 is thus enhanced to enable the rotational angle of the control shaft 68 with high accuracy.

On the other hand, in the high lift region where the control arm 71 has swung to the position indicated by the chain line, since the connecting shaft 83 of the sensor arm 81 fixed to the sensor shaft 80*a* of the rotational angle sensor 80 is engaged with the base side (the side closer to the axis C) of the guide groove 82 of the control arm 71, even a large swing of the control arm 71 results in a slight swing of the sensor arm 81. This reduces the ratio of the rotational angle of the sensor shaft 80*a* relative to the rotational angle of the control shaft 68. Consequently, the accuracy with which the rotational angle of the control shaft 68 is detected decreases compared to the case where the lift is low.

Figure 12:
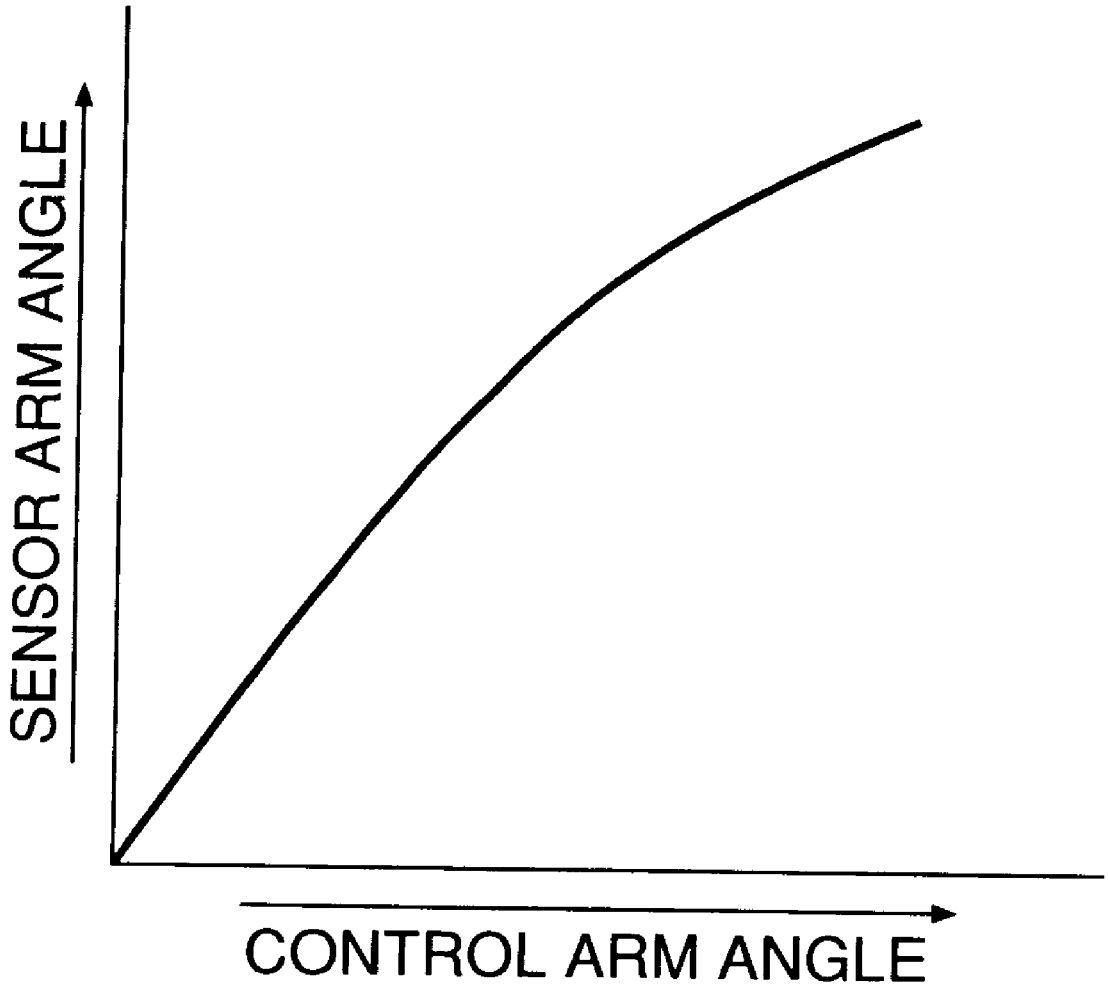
FIG. 12 is a graph showing the relationship between the rotational angle of a control arm and the rotational angle of a sensor arm. (Embodiment 1)

As is clear from the graph in FIG. 12, when the rotational angle of the control arm 71 increases from a low lift state to a high lift state, the detection accuracy is high at first. This is because at this point, the rate of increase in the angle of the sensor arm 81 is high. However, the rate of increase falls gradually, reducing the detection accuracy.

Thus, without an expensive rotational angle sensor with a high detection accuracy, by engaging the sensor arm 81 of the rotational angle sensor 80 with the guide groove 82 of the control arm 71, it is possible to ensure a high detection accuracy in a low lift state where such a detection accuracy is required. This contributes to cost reduction.

In this arrangement, one end (the end closer to the spindle 68*c*) of the control arm 71 and one end (the end closer to the rotational angle sensor 80) of the sensor arm 81 are placed in proximity to each other. Further, the guide groove 82 is formed at the end of the control arm 71. Accordingly, the sensor arm 81 can be made compact with its length reduced. Further, the formation of the guide groove 82 at the end of the control arm 71 reduces the distance from the axis C as well as the amount of travel in the circumferential direction of the guide groove 82. However, the length of the sensor arm 81 is also reduced to allow the sensor arm 81 to turn through a sufficient angle. This ensures the accuracy with which the rotational angle of the sensor 80 is detected.

Now, the operation of the present embodiment will be described. In the variable lifting mechanism 33 which continuously varies the lift amounts of the intake valves 19, the first connection portions 61*a*, 61*a* and second connecting portion 62*a*, attached to the first ends of the first link arm 61 and second link arm 62, respectively, are arranged in parallel and relatively turnably connected to the second end of the rocker arm 63 which has a valve connecting portion 63*a* interlocked and coupled to the pair of intake valves 19 at the first end. The fixed support portion 61*b* at the second end of the first link arm 61 is turnably supported by the fixed support shaft 67 of the engine body 10. The movable support portion 62*b* at the second end of the second link arm 62 is turnably supported by the displaceable movable shaft 68*a*.

Thus, by varying the movable support shaft 68*a* continuously, it is possible to vary the lift amounts of the intake valves 19 continuously. Moreover, since the first ends of the first and second link arms 61 and 62 are turnably connected directly to the rocker arm 63, it is possible to reduce the size of the space in which the link arms 61 and 62 are arranged. This makes it possible to reduce the size of the valve operating system. Further, since power is transmitted directly from the valve operating cam 69 to the roller 65 of the rocker arm 63, it is possible to follow the valve operating cam 69 properly. Furthermore, the rocker arm 63 and the first and second link arms 61 and 62 can be placed at almost the same location along the axis of the intake camshaft 31. This enables the size of the valve operating system to be reduced in a direction along the axis of the intake cam shaft 31.

Moreover, in the rocker arm 63 having the valve connecting portion 73*a* into which the tappet screws 70, abutting the pair of intake valves 19, are screwed so that their advance/retract positions can be adjusted, and the first and second support portions 63*b* and 63*c* to which the first ends of the first and second link arms 61 and 62 are turnably connected, the valve connecting portion 63*a* has a width larger than that of the remaining part in a direction along the turning axis of the valve operation cam 69. The width of the rocker arm 62 can thus be reduced in the direction along the turning axis of the valve operating cam 69. This also makes it possible to reduce the size of the valve operating system. In addition, the rocker arm 63 is formed so that the first and second support portions 63*b* and 63*c* have the same width. It is thus possible to make the rocker arm 63 compact in size, while simplifying the shape of this component.

Further, the first support portion 63*b*, provided on the rocker arm 63, is formed into a substantial U shape so as to sandwich the roller 65 between its linear portions. The roller 65 is rotatably supported by the first support portion 63*b*. Accordingly, the whole rocker arm 63, including the roller 65, can be made compact in size. Moreover, the paired first connecting portions 61*a* sandwiching the first support portions 63*b* between them are provided at the first end of the first link arm 61. Both first connecting portions 61*a* are turnably connected to the first support portion 63*b* via the first connecting shaft 64. The roller 65 is supported by the first support portion 63*b* via the first connecting shaft 64. Consequently, the common first connecting shaft 64 is used to turnably connect the first end of the first link arm 61 to the first support portion 63*b* and to allow the first support portion 63*b* to support the roller 65. This makes it possible to reduce the number of parts required and the size of the valve operating system.

The first and second connecting holes 49 and 50 are formed in the first and second support portions 63*b* and 63*c* of the rocker arm 63 so as to lie side by side in the direction in which the intake valves 19 are opened and closed; the first and second connecting shafts 64 and 66 to which the first ends of the first and second link arms 61 and 62*a* returnably connected are inserted into the first and second connecting holes 49 and 50. The first and second support portions 63*b* and 63*c* are connected together by the connecting walls 63*d* at least partly arranged opposite both intake valves 19 with respect to the tangent L which contacts with the outer edges of the first and second connecting holes 49 and 50 on the side of both intake valves 19. This serves to enhance the rigidity of the first and second support portions 63*b* and 63*c*.

Further, the concave portions 51 are formed in the connecting walls 63*d* so as to sit opposite the second connecting position 62*a* when the second connecting portion 62*a* at the second end of the second link arm 62 is closest to the rocker arm 63. Accordingly, the second connecting portion 62*a* of the second link arm 62 can be displaced to a position where it is as close to the rocker arm 63 as possible. This makes it possible to set the maximum lift amount of the intake valve 19 at as large a value as possible while reducing the size of the valve operating system.

Moreover, the lightening portions 52 are formed in the connecting walls 63*d*. This suppresses an increase in the weight of the rocker arm 63, while allowing the rigidity to be enhanced using the connecting walls 63*d*.

The oil jets 58 are fixedly arranged in the engine body 10 to supply oil to the first connecting shaft 64, the upper one of the first and second connecting shafts 64 and 66, which connect the first ends of the first and second link arms 61 and 62 to the rocker arm 63. Oil infiltrating between the rocker arm 63 and the first link arm 61, the upper one of the first and second link arms 61 and 62, flows downward to infiltrate between the second link arm 62 and the rocker arm 63. Therefore, the simple lubricating structure with a reduced number of parts can be used to lubricate both connecting portions of the rocker arm 63 with the first and second link arms 61 and 62. This ensures that the vales operate smoothly.

Furthermore, the first support portion 63*b*, formed into a general U shape so as to sandwich the roller 65 between its linear portions, is provided on the rocker arm 63. The first connecting portion 61*a* at the first end of the first link arm 61 is turnably connected to the first support portion 63*b* via the first connecting shaft 64, which supports the roller 65. The oil jets 58 are disposed in the engine body 10 so as to supply oil to the mating surfaces of the first link arm 61 and first support portion 63*b*. It is thus possible to lubricate even the supported portion of the roller 65.

Moreover, the oil jets 58 are disposed in the caps 45 of the intake cam holders 46, provided in the engine body 10 so as to rotatably support the intake cam shaft 31 on which the valve operating cam 69 is provided. Consequently, by utilizing an oil path for lubricating between the intake cam shaft 31 and the intake cam holders 46, it is possible to supply a sufficient amount of oil through the oil jets 58 under a sufficiently high pressure.

Further, the variable lifting mechanism 33 is equipped with the control shaft 68 formed into a crank-shape and has the pair of crank webs arranged on the opposite sides of the second link arm 62, the movable shaft 68*a* connecting the crank webs 68*b* together at right angles, and the support shafts 68*c* connected to the crank webs 68*b* at right angles at the positions offset from the movable shaft 68*a* and turnably supported by the engine body 10. The support shaft 68*c* is turnably supported by the head cover 16 of the engine body 10. Accordingly, by turning the control shaft 68 around the axis of the support shaft 68*c*, it is possible to easily displace the movable shaft 68*a*. This simplifies the mechanism in which the actuator motor 72 displaces the movable shaft 68*a*.

The intake valves 19 are biased by the valve springs 24 in the valve opening direction. However, the rocker arm 63 is biased by the rocker arm biasing springs 54, which is different from the valve springs 24, in the direction in which the roller 65 abuts against the valve operating cam 69. Accordingly, even when the intake valves 19 are closed, the roller 65 of the rocker arm 63 does not leave the valve operating cam 69. This improves the accuracy with which the valve lift amount is controlled when the intake valves 19 are slightly opened.

Further, the rocker arm biasing springs 54 are coil-shaped torsion springs surrounding one of the fixed support shaft 67 and movable shaft 68*a* turnably supporting the second arms of the first and second link arms 61 and 62, in the present embodiment, the fixed support shaft 67. This serves to reduce the size of the space in which the rocker arm biasing springs 54 are installed, as well as the size of the valve operating system.

Furthermore, the roller 65 is axially supported by the rocker arm 63 via the first connecting shaft 64 connecting the first end of the first link arm 61 to the rocker arm 63. The locking pins 55 are installed on the support walls 44*a* of the intake cam holder 46, provided in the engine body 10 so as to turnably support the cam shaft 31 on which the valve operating cam 69 is provided; the locking pins 55 are located outside the movable range of the second link arm 62 on a projection of a plane orthogonal to the axis of the movable shaft 68*a*. The first ends of the rocker arm biasing springs 54 are engaged with the first connecting shaft 64. The second ends of the rocker arm biasing springs 54 are engaged with the locking pins 55. As a result, the rocker arm biasing springs 54 can be arranged while reliably avoiding interferences with the second link arm 62.

Furthermore, a pair of the crank webs 68*b* are arranged inward of a pair of the rocker arm biasing springs 54 surrounding the fixed support shaft 67 on the opposite sides of the second end of the first link arm 61. Consequently, the control shaft 68 can be placed as close to the fixed support shaft 67 as possible. This makes is possible to reduce the size of the valve operation system.

Moreover, the pair of support bosses 53, 53 supporting the fixed support shaft 67 are provided on the support walls 44*a* of the intake cam holders 46 of the engine body 10 so as to sandwich the second end of the first link arm 61 between the bosses 53, 53. The rocker arm biasing springs 54 are provided between the engine body 10 and the rocker arm 63 so as to surround the support bosses 53, 53. Accordingly, the pair of support bosses 53, 53 avoids the adverse effect of the contraction of the rocker arm biasing springs 54 on the fixed support shaft 67, while regulating the movement of the fixed support portion 61*b* at the second end of the first link arm 61. This enables the rocker arm biasing springs 54 to be arranged in compact form.

The cylindrical fixed support portion 61*b* is provided at the second end of the first link arm 61; the outer periphery of the fixed support portion 61*b* is located inward of the outer periphery of each rocker arm biasing spring 54 as viewed laterally. The fixed support portion 61*b* is turnably supported by the fixed support shaft 67. However, the plurality of projecting portions 56, 57 are provided at the axial opposite ends of the fixed support portion 61*b* at intervals in the circumferential direction so as to stick out from the axial opposite ends; the projecting portions 56, 57 inhibit the rocker arm biasing springs 54 from being laid down toward the fixed support portion 61*b*. Therefore, it is possible to prevent the rocker arm biasing springs 54 from being laid down as described above, while suppressing an increase in the size of the fixed support portion 61*b*. The supporting rigidity of the fixed support portion 61*b* can therefore be improved.

Moreover, the projecting portions 56, 57 are arranged outside the operating range of the second link arm 62. Accordingly, even though the projecting portions 56, 57 are provided on the fixed support portion 61*b*, the second link arm 62 can be provided with a sufficient operating range.

The embodiment of the present invention has been described. However, the present invention is not limited to the embodiment described above. The present invention allows various design changes without departing from the scope of the present invention set forth in the appended claims.

The invention claimed is:

1. An engine valve operating system comprising a rocker arm (63) which has a cam abutting portion (65) abutting against a valve operating cam (69) and is interlocked and connected so as to apply a force in a valve opening direction to an engine valve (19) biased by a valve spring (24) in a valve closing direction, a first link arm (61) having one end turnably connected to the rocker arm (63) and the other end turnably connected at a fixed position of the engine body (10), a second link arm (62) having one end turnably connected to the rocker arm (63) and the other end turnably supported by a displaceable movable shaft (68*a*), driving means (72) connected to the movable shaft (68*a*) to enable a position of the movable shaft (68*a*) to be displaced in order to continuously vary the lift amount of the engine valve (19), and a rocker arm biasing spring (54) which is different from the valve spring (24) and which biases the rocker arm (63) in a direction in which the cam abutting portion (65) abuts against the valve operating cam (69).

2. The engine valve operating system according to claim 1, wherein a roller which is the cam abutting portion (65) is axially supported by the rocker arm (63) via a connecting shaft (64) which connects one end of the first link arm (61) to the rocker arm (63), a locking pin (55) located outside a movable range of the second link arm (62) on a projection of a plane orthogonal to an axis of the movable shaft (68*a*) is installed on a cam holder (46) provided in the engine body (10) so as to rotatably support a cam shaft (31) on which the valve operating cam (69) is provided, and one end of the rocker arm biasing spring (54) is engaged with the connecting shaft (64), while the other end of the rocker arm biasing spring (54) is engaged with the locking pin (55).

3. The engine valve operating system according to claim 1, wherein the rocker arm biasing spring (54) is a coil-shaped torsion spring surrounding one of a fixed support shaft (67) and the movable shaft (68*a*) which turnably support the other ends of the first and second link arms (61, 62).

4. The engine valve operating system according to claim 3, wherein the driving means (72) is connected to a control shaft (68) formed into a crank-shape and having a pair of crank webs (68*b*) arranged on opposite sides of the second link arm (62), the movable shaft (68*a*) connecting the crank webs (68*b*) together at right angles, and a support shaft (68*c*) which is connected to the crank webs (68*b*) at right angles at positions offset from the movable shaft (68*a*) and is turnably supported by the engine body (10), and a pair of the crank webs (68*b*) is arranged inward of a pair of the rocker arm biasing springs (54) surrounding the fixed support shaft (67) on opposite sides of the other end of the first link arm (61).

5. The engine valve operating system according to claim 3 or wherein a pair of support bosses (53) supporting the fixed support shaft (67) is provided in the engine body (10) so as to sandwich the other end of the first link arm (61) between the support bosses (53), and the rocker arm biasing springs (54) are provided between the engine body (10) and the rocker arm (63) so as to surround the support bosses (53).

6. The engine valve operating system according to claim 5, wherein a cylindrical fixed support portion (61*b*) is provided at the other end of the first link arm (61) so as to be turnably supported by the fixed support shaft (67), the fixed support portion (61*b*) having an outer periphery located inward of an outer periphery of each rocker arm biasing spring (54) as viewed laterally, and a plurality of projecting portions (56, 57) are provided at axial opposite ends of the fixed support portion (61*b*) at intervals in a circumferential direction so as to stick out from the axial opposite ends, in order to inhibit the rocker arm biasing springs (54) from being laid down toward the fixed support portion (61*b*).

7. The engine valve operating system according to claim 6, wherein the projecting portions (56, 57) are arranged outside an operating range of the second link arm (61).

8. The engine valve operating system according to claim 4, wherein a pair of support bosses (53) supporting the fixed support shaft (67) is provided in the engine body (10) so as to sandwich the other end of the first link arm (61) between the support bosses (53), and the rocker arm biasing springs (54) are provided between the engine body (10) and the rocker arm (63) so as to surround the support bosses (53).

9. The engine valve operating system according to claim 8, wherein a cylindrical fixed support portion (61*b*) is provided at the other end of the first link arm (61) so as to be turnably supported by the fixed support shaft (67), the fixed support portion (61 *b*) having an outer periphery located inward of an outer periphery of each rocker arm biasing spring (54) as viewed laterally, and a plurality of projecting portions (56, 57) are provided at axial opposite ends of the fixed support portion (61*b*) at intervals in a circumferential direction so as to stick out from the axial opposite ends, in order to inhibit the rocker arm biasing springs (54) from being laid down toward the fixed support portion (61*b*).

10. The engine valve operating system according to claim 8, wherein the projecting portions (56, 57) are arranged outside an operating range of the second link arm (61).

* * * * *